US006441548B1

(12) United States Patent
Arimoto

(10) Patent No.: US 6,441,548 B1
(45) Date of Patent: Aug. 27, 2002

(54) DISCHARGING AND LIGHT EMITTING DEVICE

(75) Inventor: Hironobu Arimoto, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 203 days.

(21) Appl. No.: 09/617,809

(22) Filed: Jul. 17, 2000

(30) Foreign Application Priority Data

Feb. 18, 2000 (JP) ..... 2000-041131

(51) Int. Cl.[7] ..... H01J 1/62
(52) U.S. Cl. ..... 313/491; 313/631
(58) Field of Search ..... 313/491, 495, 313/620, 631, 634

(56) References Cited

FOREIGN PATENT DOCUMENTS

| | | |
|---|---|---|
| JP | 63-29935 | 6/1988 |
| JP | 3-110750 | 5/1991 |
| JP | 4-360458 | 12/1992 |
| JP | 8-287869 | 11/1996 |

*Primary Examiner*—Vip Patel
(74) *Attorney, Agent, or Firm*—Oblon, Spivak, McClelland, Maier & Neustadt, P.C.

(57) ABSTRACT

A discharging and light emitting device includes a substrate and a transparent substrate. A discharging space is formed between the substrate and the transparent substrate, and a discharging gas is enclosed in the discharging space. The substrate has an inner electrode, and the transparent substrate has an outer electrode. These substrates are placed shifted from one another so that the inner electrode and outer electrode do not overlap.

15 Claims, 6 Drawing Sheets

DISCHARGING AND LIGHT EMITTING DEVICE

BACKGROUND OF THE INVENTION

1. Field of the Invention

The present invention relates to a discharge and light emitting device in which a discharge gas such as xenon enclosed between electrodes is discharged for emitting light.

2. Description of the Background Art

Various light emitting devices have been proposed and reduced to practice as a light source. One of such conventional devices is a light source used for a contact image sensor (hereinafter as CIS) which reads a content such as diagram.

FIGS. 11 and 12 show an example of such a CIS, CIS 100 including a conventional light source. FIG. 11 is a plan view of CIS 100 disclosed by Japanese Patent Laying-Open No. 4-360458 (Japanese Patent No. 2953595), and FIG. 12 is a cross sectional view of CIS 100 shown in FIG. 11.

As shown in FIGS. 11 and 12, CIS 100 includes an LED (Light Emitting Diode) array 101 as a light source, a casing 102, a sensor IC (integrated Circuit) 103, a rod lens array 104, and a glass plate 105.

A document 106 between a platen 107 and glass plate 105 is irradiated with light by LED array 101, and reflected light is passed through rod lens array 104 to reach sensor IC 103. The reflected light is then converted into an electrical signal by sensor IC 103 and the content of document 106 is read.

The use of LED array 101 as a light source for a contact image sensor as described above is encountered with the following various disadvantages.

When an LED is used as a light source, the necessary light amount of the light source changes depending upon the time required by the image sensor to read one line of information in the case of a line sensor. This means that the signal output I of the sensor has the relation represented as I T×B relative to the reading speed (reading time T per line) and the brightness B of the light source. Therefore, if reading time T is large (a document is read by a facsimile machine for example at the speed of ~10 ms/line), an output from the sensor is tolerable for use.

Note however that reading time T would be very small for high speed reading at a speed of 0.5 ms/line or less, and therefore sufficient sensor output does not result.

When LED chips are arranged, the optical output of the LED chips has strong directivity, the light amount is much different between forward and diagonally forward directions, and therefore the following problem is encountered. When a light source is manufactured using an arrangement of LED chips, a gap is present between LED chips by the restriction of the mounting pitch, which causes difference in the light amount between the region over the LED chips and the region over the gaps. As a result, a corrugation is generated in the amount of light at the LED mounting pitch in the direction of the arrangement of the LED chips.

Furthermore, because of variation in the LED mounting precision (precision at which the light emitting center of the LEDs is aligned on one line) and the directivity of the light amount as described above, the above corrugation could be larger.

In addition, there is variation in the brightness itself of LED chips, and therefore, using an arrangement of LED chips, the brightness variation is reflected upon the brightness distribution on a line. Therefore, the light amount could not be uniform for the entire illumination length.

When a high brightness is to be achieved, LED chips must be mounted in a high density to increase current contributing to light emission, which however causes the light source to generate heat and hence reduces the useful life of the LED chips.

As a light source for a CIS, a conventional, cylindrical lump such as a hot cathode tube (fluorescent lamp) and a cold cathode tube could be used. In this case, a sufficient amount of light as a light source could be obtained.

However, the inner shape of the CIS must have such a form to receive the cylindrical light source, and therefore the cross sectional shape would be large. Since such a lamp has electrodes at both ends, a lower brightness portion as long as several centimeters called "cathode dark space" is necessarily formed. As a result, the percentage of the region having a stable light amount relative to the entire length of the light source is reduced.

The inventor has eagerly studied and come to conceive the use of a light source which emits light by discharge for the light source of the contact image sensor, and succeeded in the development of a light source of this type. FIG. 1 shows an example of a discharging and light emitting device 1 which can be used as the light source.

As shown in FIG. 1, discharging and light emitting device 1 includes a substrate 2, a transparent substrate 3, an inner electrode 4, an outer electrode 5, a metal bus 6, an insulating layer (dielectric layer) 7, a first fluorescent substance 8, a second fluorescent substance 9, a sealing layer 10, and a discharging space 11.

Substrate 2 and transparent substrate 3 are made for example of glass. Transparent substrate 3 is placed upon substrate 2, and has a wall 3*a* extending toward substrate 2. Wall 3*a* is connected to substrate 2 through sealing layer 10 and insulating layer 7. Thus, a discharging space 11 is formed between substrate 2 and transparent substrate 3. A discharge gas such as xenon is enclosed in discharging space 11. Note that sealing layer 10 is made of a glass layer formed for example by melting frit.

Inner electrode 4 is formed on substrate 2, and covered with insulating layer 7. Insulating layer 7 is for example made of a glass layer. First fluorescent substance 8 is formed on insulating layer 7, and second fluorescent substance 9 is formed on the surface of transparent substrate 3.

Outer electrode 5 is for example made of ITO (Indium Tin Oxide) or $SnO_2$, and has transmittancy. Outer electrode 5 formed on the outer surface of transparent substrate 3 forms metal bus 6 on the periphery of outer electrode 5.

In order to allow discharging and light emitting device 1 having the above construction to emit, a prescribed voltage (for example, about 1000V) is applied between inner electrode 4 and outer electrode 5. Thus, a discharge gas is electrolytically dissociated to discharge ultraviolet rays, which are then directed upon first and second fluorescent substances 8 and 9 and these substances emit light.

The inventor has confirmed that the brightness of light thus obtained is higher than the conventional case using the LEDs. The brightness distribution is homogeneous, the useful life of discharging and light emitting device 1 is significantly longer than that of the LEDs. The percentage of the effective illumination length is much increased, which makes it easier to reduce the size in the longitudinal direction. Furthermore, since no toxic substance such as mercury is used, the risk of environmental destruction can be avoided.

While discharging and light emitting device 1 shown in FIG. 1 may provide various, more excellent effects than those of the conventional device as described above, the inventor has further advanced his study to come across the following, new problem to be solved for such discharging and light emitting device 1. The problem will be now described.

FIG. 2 shows a discharging path 12*a* in discharging space 11 when discharging and light emitting device 1 emits light. Note that the arrow in FIG. 2 represents the direction in which light is emitted.

As shown in FIG. 2, since inner electrode 4 and outer electrode 5 are placed opposing each other, discharging path 12*a* is positioned vertically to the main surface of each of substrates 2 and 3. The length of discharging path 12*a* is therefore as short as the shortest distance between substrates 2 and 3.

In a light source using gas discharging, the brightness and light emission efficiency typically increase as a function of the length of the discharging path length. As a result, the short discharging path length as described above could lower the brightness and light emission efficiency in discharging and light emitting device 1.

SUMMARY OF THE INVENTION

The present invention is directed to a solution to the above described problem. It is one object of the present invention to provide a discharging and light emitting device providing an increased brightness, a more homogeneous distribution of brightness, prolonged useful life, a higher percentage of effective illumination length and improved light emission efficiency and allowing the longitudinal size to be reduced, and the environmental destruction to be avoided.

A discharging and light emitting device according to the present invention includes first and second substrates, first and second fluorescent substances, and first and second electrodes. The second substrate is placed upon the first substrate to form a discharging space into which a discharging gas is enclosed with the first substrate and has transmittancy. The first and second fluorescent substances are provided in the discharging space. The first electrode is provided on the side of the first substrate and the second electrode is provided on the side of the second substrate. The second electrode is provided shifted from the first electrode such that the first and second electrodes do not overlap.

By thus providing the second electrode shifted from the first electrode, the discharging path can be tilted at a prescribed angle relative to the direction vertical to the main surfaces of the first and second substrates. More specifically, the discharging path can be directed slightly diagonally to the main surfaces of the first and second substrates. As a result, the discharging path length (discharging gap) can be larger than the case shown in FIG. 1, and the brightness and light emission efficiency can be improved. Discharging light emission is caused in the direction connecting the first electrode and the second electrode, and therefore a light emitting region is hardly generated immediately under the electrodes, so that all the emitted light can be taken to the outside. This also contributes to the improved light emission efficiency. Furthermore, if discharged light is taken using discharging, the smaller the density of the current passed at the time of discharging, the greater will be the light emission efficiency. As a result, if the first electrode is provided shifted from the second electrode, strong discharging is generated in the direction connecting the first and second electrodes, while discharging is weak in the other region. Thus, there is a current density distribution, a low current density region is formed, and the light emission efficiency in total can be improved.

The first substrate has the first fluorescent substance and the second substrate has the second fluorescent substance. The first fluorescent substance preferably has a larger thickness than the thickness of the second fluorescent substance. Thus, light can be emitted through the second substrate.

The first electrode is provided on a surface on the discharging space side in the first substrate, the second electrode is provided on an outer surface on the opposite side to the discharging space side in the second substrate. The second electrode is at a ground potential.

Since the second electrode which could be in contact with the outside is set at a ground potential, the risk of electric shock by touching the second electrode can be avoided and the safe operation environment can be secured. When the casing of the discharging and light emitting device is set at a ground potential, the casing and the second electrode do not have to be insulated from one another any longer, which prevents the structure from being complicated and enlarged. Furthermore, the shielding effect against an EMI (radiation noise) from the light taking portion can be provided. The driving frequency for emitting light is in the range from 50 KHz to 100 KHz, and the wavelength is larger than the opening of the light source (discharging and light emitting device), so that the shield effect can be expected for this structure as well.

Preferably, the second substrate has a wall (spacer) extending toward the first substrate, and the second electrode is provided on the inner side than the wall of the second substrate.

If a substance having a large dielectric constant is present between the electrodes other than the discharging gas, a capacitor forms between the substance and the electrodes. The capacitor has a larger capacitance than the discharging gas space. When a voltage to cause light emission is externally applied, the number of charges not contributing to the light emission and charging the capacitor is greater than that of charges for raising the voltage for the discharging space, which lowers the efficiency as a whole (the percentage of the light amount relative to input power). Since the dielectric constant of the wall described above is large, and therefore by providing the second electrode on the inner side than the wall, the wall can be prevented from being provided with voltage, and the efficiency can be prevented from being lowered. Thus, wasteful power consumption can be reduced, and the light emission efficiency can be improved.

The first electrode may be provided on an outer surface positioned on the opposite side to the discharging space side in the first substrate, while the second electrode may be provided on a surface on the discharging space side in the second substrate. In this case, the first electrode is set at a ground potential.

An insulating layer covering the second electrode and having transmittancy is preferably provided. Thus, light can be let out through the insulating layer.

The above insulating layer may be provided with an opening to reach the second substrate, and the second fluorescent substance may be formed on the surface of the second substrate positioned in the opening.

When light is emitted to the outside from the insulating layer side, the above opening permits light to be passed through the opening for emission to the outside. Thus, the brightness can be increased as compared to the case of emitting light through the insulating layer to the outside. The transparency of the insulating layer does not have to be improved in this case.

A wall extending toward the second substrate may be formed on the side of the first substrate. In this case, the first electrode is provided on the inner side of the wall of the first substrate. Also in this case, the light emission efficiency can be improved.

The first electrode is formed into a flat plate (strip) shape, and the second electrode is formed into an annular shape. In this case, discharging is caused on both sides of the first electrode, and the brightness and light emission efficiency can be further improved. In addition, discharging light emission is generated in the region surrounded by the annular second electrode, a light emitting region is less likely to be formed immediately under the electrodes, and therefore all the emitted light can be let out. Also in this case, a low current density region can be positively produced, which improves the light emission efficiency in total. If one side of the second electrode being disconnected, it will not be defective and the margin relative to the disconnection of electrodes can be improved. Furthermore, the outlet of light can be clearly defined by the second electrode.

The discharging and light emitting device according to the present invention is particularly useful as a light source for a contact image sensor.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be now described in conjunction with FIGS. 3 to 9.

First Embodiment

Figure 3:
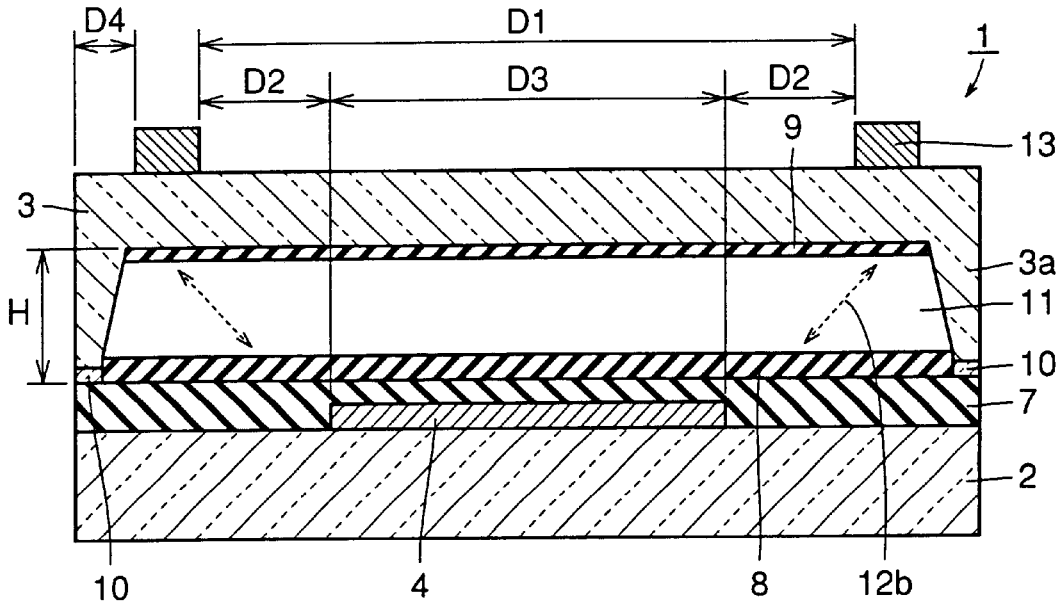
FIG. 3 is a cross sectional view of a discharging and light emitting device according to a first embodiment of the present invention.

FIG. 3 is a cross sectional view of a discharging and light emitting device 1 according to the present invention. The portions having the same construction as those shown in FIG. 1 are denoted by the same reference characters and are not described.

As shown in FIG. 3, in discharging and light emitting device 1 according to this embodiment, outer electrode 5 is omitted and a new outer electrode 13 is provided. Outer electrode 13 is selectively formed on the outer surface of transparent substrate 3 (the surface positioned opposite to discharging space 11) and at a ground potential.

Figure 1:
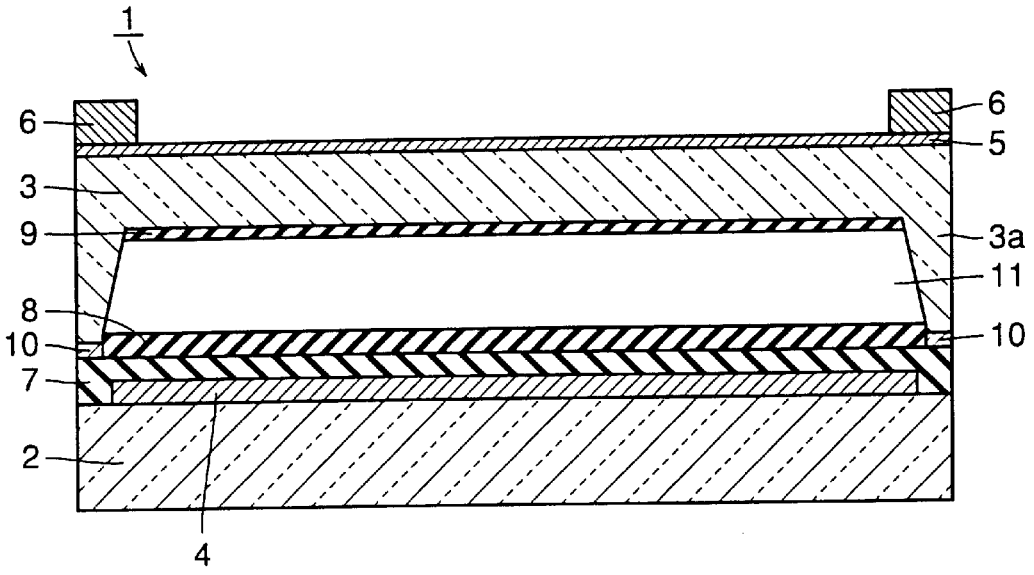
FIG. 1 is a cross sectional view of a discharging and light emitting device thought up by the invention.
Figure 2:
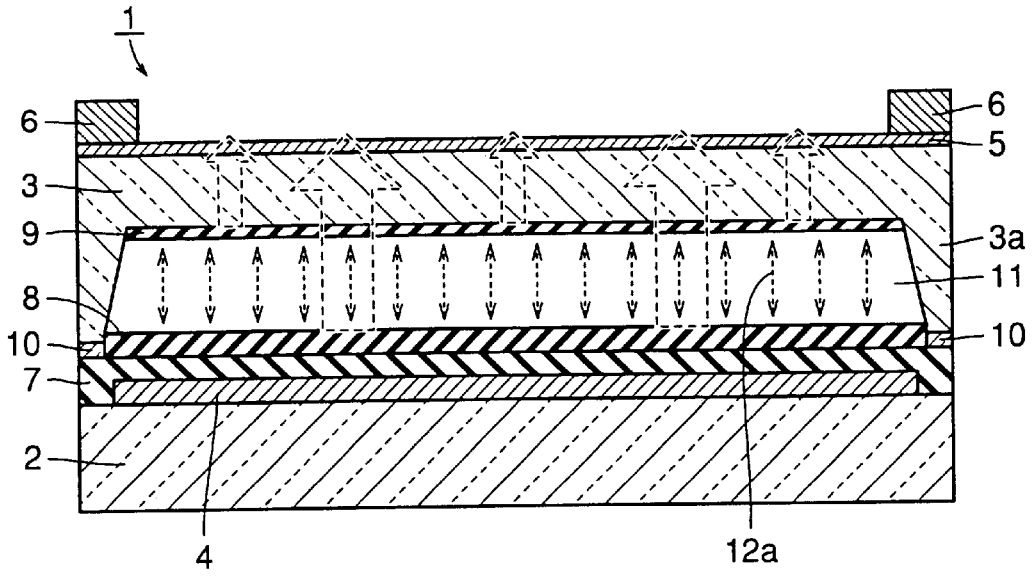
FIG. 2 is a cross sectional view of the state in which the discharging and light emitting device in FIG. 1 is emitting light.

The light transmittance of outer electrode 5 as shown in FIG. 1 is about 80%, and therefore removing this outer electrode 5, the efficiency is improved by about 20% than the case shown in FIG. 1.

Figure 4:
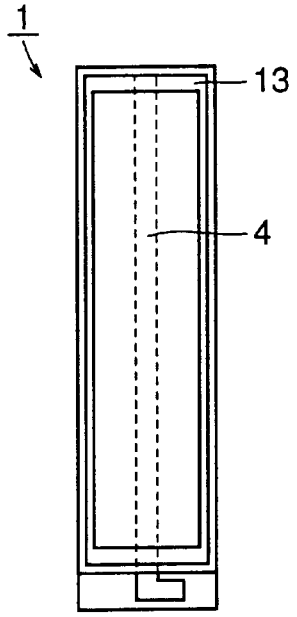
FIG. 4 is a plan view of the discharging and light emitting device according to the first embodiment.

Outer electrode 13 is made of a metal such as Cu, Al, Ag, Au and Ni or a combination thereof, and has an annular shape as shown in FIG. 4. The outer peripheral shape of outer electrode 13 is typically rectangular, but any arbitrary shape can be selected. Outer electrode 13 may be adhesively attached to transparent substrate 3 through an adhesive layer (not shown), or outer electrode 13 may be covered with a transparent, adhesive sheet (not shown), and attached to transparent substrate 3 by attaching the sheet to the substrate.

As shown in FIG. 3, outer electrode 13 is positioned on the inner side than wall 3*a,* and the outer periphery of outer electrode 13 is separated from the wall 3*a* of substrate 3. More specifically, the distance D4 between the outer periphery of outer electrode 13 and wall 3*a* is preferably 0.5 mm or more. By thus separating the outer periphery of outer electrode 13 and wall 3*a,* wall 3*a* can be prevented from being provided with voltage, and wasteful power consumption can be avoided.

Inner electrode 4 is formed on a surface on the side of discharging space 11 in substrate 2, and its width is smaller than that in FIG. 1. Thus, a gap may be provided in the horizontal direction between the inner periphery of outer electrode 13 and the outer periphery of inner electrode 4, so that outer electrode 13 can be prevented from being overlapped with inner electrode 4. More specifically, outer electrode 13 and inner electrode 4 can be shifted from one anther in the horizontal direction.

Thus, discharging path 12*b* may be directed in the diagonal direction to the main surface of substrate 2, therefore the discharging path length can be increased and the light emission efficiency can be improved. Since the light emitting region can be placed in the region surrounded by outer electrode 13, ultraviolet rays generated by discharging can be effectively used.

When discharge light is taken using discharging, it is known that the smaller the density of current passed at the time of discharging, the greater will be the light emission efficiency. In the structure shown in FIG. 1, the current density is equal, and in order to change the density, externally applied voltage needs only be changed. In the structure shown in FIG. 1, however, if the applied voltage is lowered to lower the current density, unstable discharging results, and homogeneous light emission cannot be performed. Therefore, the lowest applicable voltage is limited.

In contrast, if outer electrode 13 and inner electrode 4 are placed shifted from one another as described above, discharging is strong in the direction connecting outer and inner electrodes 13 and 4, and weak in the other region. Therefore, a distribution of the current density is produced, and a region with a low current density may be positively provided. As a result, the light emission efficiency in total can be improved.

Figure 6:
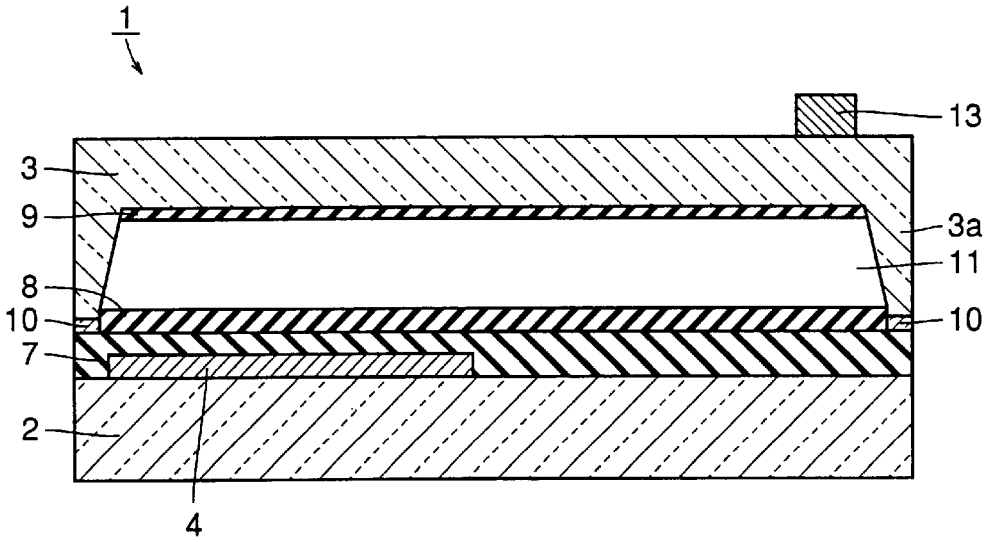
FIG. 6 is a cross sectional view of a modification of the discharging and light emitting device shown in FIG. 3.

Note that if the discharging path length can be increased, outer electrode 13 may be provided in the vicinity of the right end of transparent substrate 3, while inner electrode 4 may be provided in the vicinity of the left end of substrate 2 as shown in FIG. 6. Thus, the discharging path length may be even larger than the case shown in FIG. 3.

The inventor has found a preferable relation among distance D2 between outer electrode 13 and inner electrode 4, the width D3 of inner electrode 4, and the height H of discharging space 11, and the relation will be now described.

Figure 5:
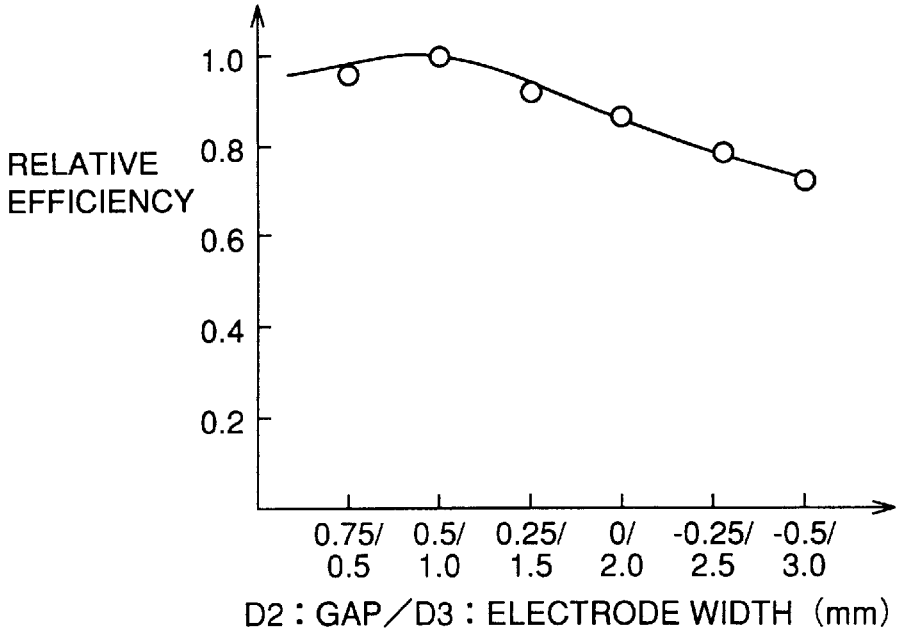
FIG. 5 is a graph showing the relation among the relative efficiency, the distance between electrodes and the width of the inner electrode.

More specifically, distance D2 and height H preferably satisfy the relation $D2 \leqq (H/2)$. The reason for this will be described referring to FIG. 5. FIG. 5 shows the relation among distance D2 between outer electrode 13 and inner electrode 4, the width D3 of inner electrode 4, and relative efficiency when height H is 1 mm.

As shown in FIG. 5, the relative efficiency is at maximum when distance D2 is 0.5 mm, width D3 is 1.0 mm, and is lowered as outer electrode 13 and inner electrode 4 come to be overlapped. This shows that the relative efficiency can be improved when distance D2 is 0.5 mm or more for height H of 1 mm, in other words, when the relation $D2 \leqq (H/2)$ is satisfied.

Note that distance D1 between outer electrodes 13 is represented by $D1=2\times D2+D3$, and is 2 mm for the maximum relative efficiency. More specifically, when the relative efficiency is at maximum, distance D1 is twice as large as height H.

First and second fluorescent substances 8 and 9 will be now described. The emission color of the light source is generally determined by a fluorescent substance excited by vacuum ultraviolet rays. For example, for a greenish yellow high brightness light source, a LaPO4:Ce, Tb based fluorescent substance is used, while for a white light source, a greenish yellow fluorescent substance, a red fluorescent substance (for example, $(Y, Gd, Eu)BO_3$, $(Y, Gd, Eu)_2O_3$), a blue fluorescent substance ($(Ba, Eu)MgAl_{10}BO_{17}$, $(Sr, Ca, Ba, Mg)_{10}Cl_2$: Eu, $Sr_{10}(PO_4)Cl_2$: Eu, etc.), and a green fluorescent substance ($(Zn_2SiO_2$: Mn, $(Zn, Mg)_2SiO_2$, etc) are mixed.

The particle size of the fluorescent substances described above are about in the range from 2 to 10 $\mu$m, and only the surface layer part of the particles emit light with ultraviolet rays. As a result, when a fluorescent substance is formed, the thickness and particle density are critical parameters to determine the light emission intensity.

As shown in FIG. 3, in discharging and light emitting device 1, there are first fluorescent substance 8 formed on substrate 2 positioned on the back side and emitting light to the side of transparent substrate 3, and second fluorescent substance 9 formed on transparent substrate 3 positioned in the front and transmitting light therethrough while emitting light itself.

Figure 9:
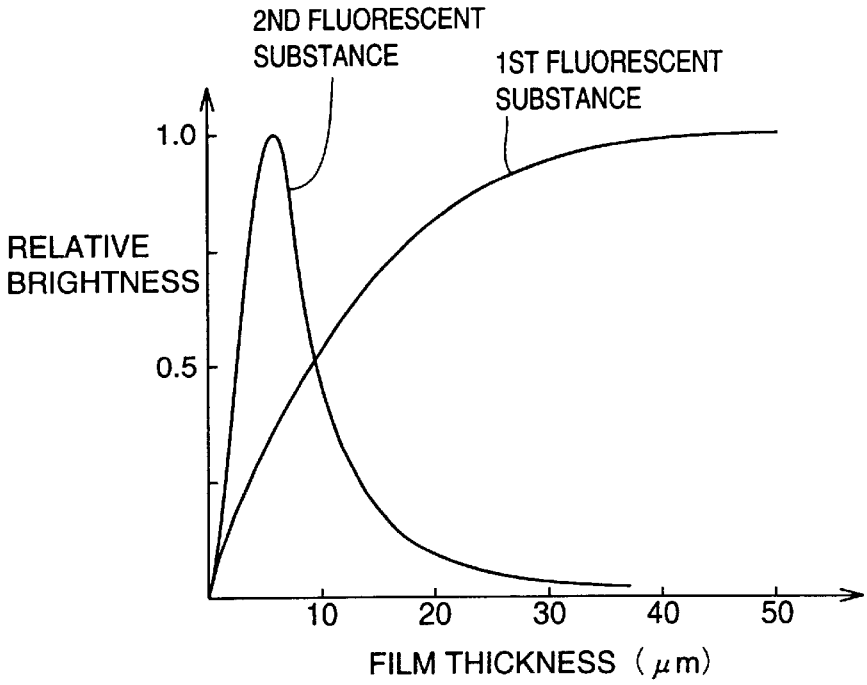
FIG. 9 is a graph showing the relation between the relative brightness, and the thickness of fluorescent substances.
Figure 10:
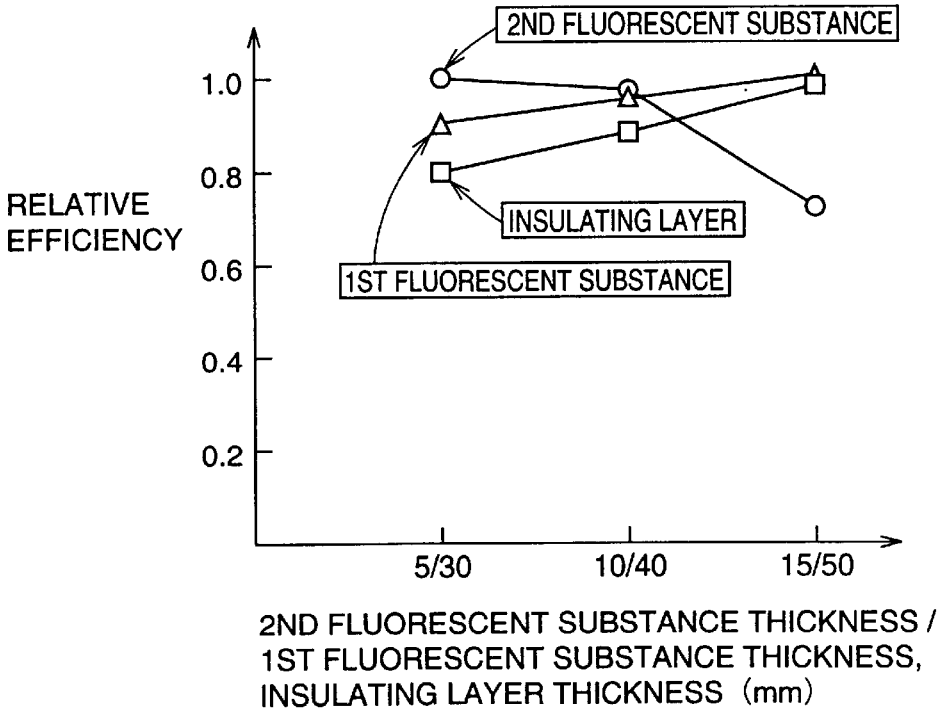
FIG. 10 is a graph showing the relation between the relative efficiency, and the thickness of the fluorescent substance and insulating layer.
Figure 11:
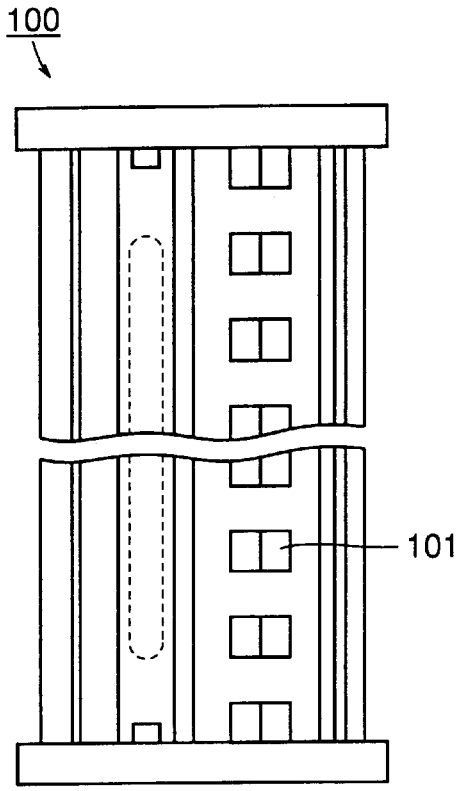
FIG. 11 PRIOR ART
FIG. 11 is a plan view of a conventional CIS.
Figure 12:
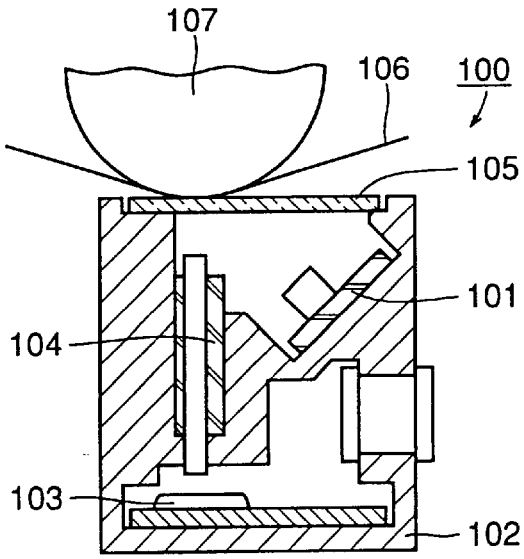
FIG. 12 PRIOR ART
FIG. 12 is a cross sectional view of the CIS shown in FIG. 11.

The inventor has studied about the relation between the thickness of first and second fluorescent substances 8, 9 and the relative brightness. The result will be described in conjunction with FIGS. 9 and 10. FIG. 9 shows the relation between the thickness of the first and second fluorescent substances 8, 9, and the relative efficiency. FIG. 10 shows the relation between the thickness of the thickness of the first and second fluorescent substances 8, 9, the thickness of insulating layer 7, and the relative brightness.

As can be seen from FIG. 9, the thickness of the first and second fluorescent substances 8, 9 affects the relative brightness. More specifically, the relative brightness may be maintained at a high level when the thickness of the first and second fluorescent substances 8, 9 is in a prescribed range.

More specifically, the thickness of first fluorescent substance 8 is preferably in the range from 40 $\mu$m to 60 $\mu$m, the thickness of the second fluorescent substance 9 is preferably in the range from 3 $\mu$m to 10 $\mu$m. More preferably, the thickness of first fluorescent substance 8 is 50 $\mu$m, and the thickness of second fluorescent substance 9 is 5 $\mu$m. Thus, the brightness of discharging and light emitting device 1 may be improved.

As can be seen from FIG. 10, the thinner the second fluorescent substance 9 is, the greater will be the efficiency, while the thicker the first fluorescent substance 8 and insulating layer 7 are, the greater will be the efficiency.

More specifically, the thickness of second fluorescent substance 9 is preferably about 5 $\mu$m as described above in view of the particle size of fluorescent substances and feasibility. However, if the thickness of second fluorescent substance 9 is about 10 $\mu$m, the efficiency is not much lowered as shown in FIG. 10. As a result, the thickness of second fluorescent substance 9 has only to be 10 $\mu$m or less.

Since first fluorescent substance 8 is not as dense as insulating layer 7, the discharge voltage does not change very much if the thickness changes, and a greater brightness results for first fluorescent substance 8 having a larger thickness. However, since the efficiency is not so much improved if the thickness of first fluorescent substance 8 is 40 $\mu$m or more, the thickness needs only be at least 40 $\mu$m.

Insulating layer 7 having a greater thickness can provide more effective protection for inner electrode 4. However, the voltage increases as the thickness of insulating layer 7 is increased, and therefore the thickness of insulating layer 7 is preferably about 50 $\mu$m or less as a practical value. Insulating layer 7 having too small a thickness may cause breakdown, and the thickness is preferably at least 30 $\mu$m, which is enough for effectively protecting inner electrode 4.

Second Embodiment

Figure 7:
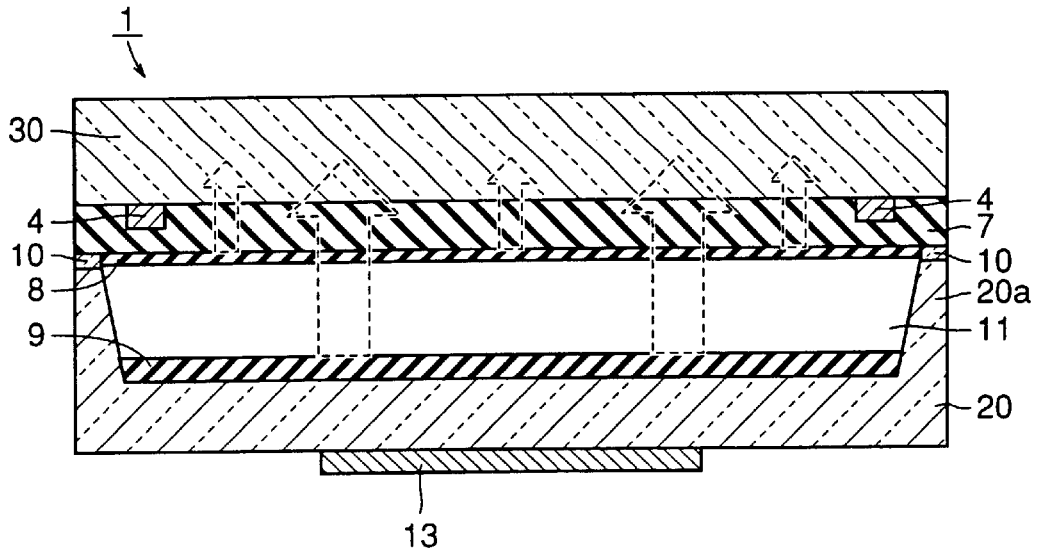
FIG. 7 is a cross sectional view of a discharging and light emitting device according to a second embodiment of the present invention.
Figure 8:
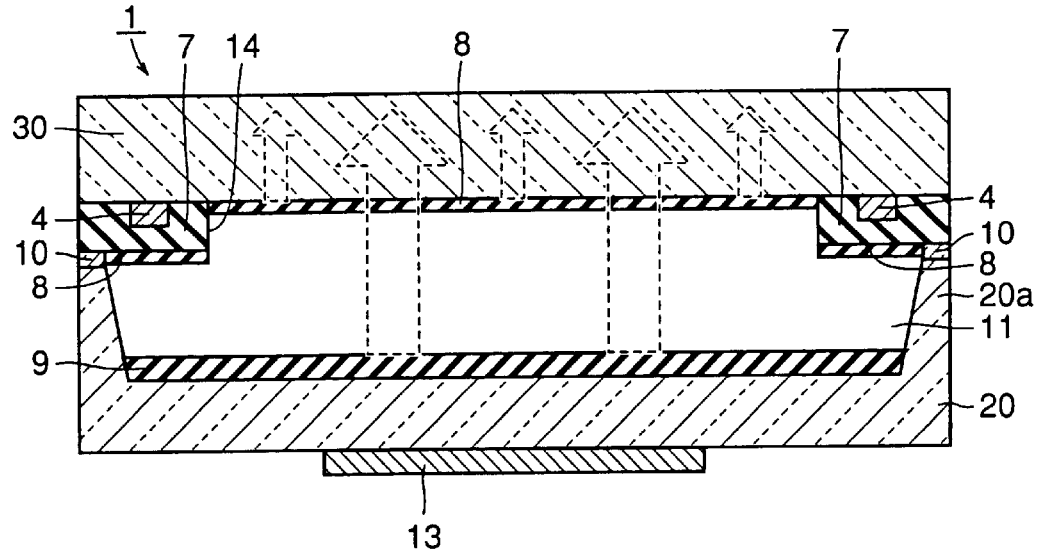
FIG. 8 is a cross sectional view of a modification of the discharging and light emitting device shown in FIG. 7.

Referring to FIGS. 7 and 8, a second embodiment of the present invention will be now described. FIG. 7 is a cross sectional view of discharging and light emitting device 1 according to a second embodiment of the present invention. FIG. 8 is a cross sectional view of a modification of discharging and light emitting device 1 shown in FIG. 7.

As shown in FIG. 7, this embodiment has a vertically reversed structure of discharging and light emitting device 1 shown in FIG. 1. More specifically, the substrate on the side of inner electrode 4 is referred to as transparent substrate 30 and outer electrode 13 is formed on the side of substrate 20.

In the above first embodiment, it is practical to form outer electrode 13 after substrate 2 and transparent substrate 3 are joined. Discharging and light emitting device 1 has an elongate shape and positioning would be difficult if outer electrode 13 having a thin electrode pattern is joined to such an elongate structure regardless of whether it is printed or joined using a tape or the like. Outer electrode 13 however serves as a window for letting light out and therefore its positioning is critical.

Therefore, in this embodiment, inner electrodes 4 are printed in the block on transparent substrate 30, and other elements are positioned by referring to transparent substrate 30. Outer electrode 13 is a strip and does not serve as a window for light, and therefore its positioning is easy.

Inner electrode 4 is formed to have an annular shape, while outer electrode 13 is formed to have a flat plate shape. A wall 20*a* is provided on the side of substrate 20. Outer electrode 13 is placed on the inner side of wall 20*a*, and is also at a ground potential in this embodiment.

According to this embodiment, emitted light is transmitted through insulating layer 7 as shown in FIG. 7, and therefore insulating layer 7 is made of a material having transmittancy. Printed glass or the like may be used for insulating layer 7.

Referring to FIG. 8, a modification of discharging and light emitting device 1 shown in FIG. 7 will be described. As shown in FIG. 8, insulating layer 7 is provided with an opening 14 reaching transparent substrate 30, and first fluorescent substance 8 may be formed on the surface of transparent substrate 30 positioned in opening 14.

By thus providing opening 14, light may be externally emitted through opening 14, so that the transparency of insulating layer 7 does not have to be increased.

As in the foregoing, the embodiments of the present invention have been described, but the invention is not limited to these embodiments.

For example, regarding the placement of inner electrode 4 and outer electrode 13, any arbitrary positioning may be employed as long as they do not overlap each other. The shape of inner electrode 4 and outer electrode 13 may be any arbitrary shape other than those described. Furthermore, while the discharging and light emitting device according to the present invention is useful for a light source for a contact image sensor, the invention has other applications.

As described above, in the discharging and light emitting device according to the present invention, the brightness of emitted light may increase, the brightness distribution may be homogeneous, the useful life may be prolonged, and the percentage of the effective illumination length may be increased, so that the longitudinal size can be reduced and not only environmental destruction can be avoided but also the emission efficiency can be increased.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A discharging and light emitting device, comprising:

a first substrate;

a second substrate placed upon said first substrate to form a discharging space with said first substrate and having transmittance, a discharging gas being enclosed in said discharging space;

first and second fluorescent substances provided in said discharging space;

a first electrode provided on the side of said first substrate; and a second electrode provided on the side of said second substrate, said second electrode being provided shifted from said first electrode such that said first and second electrodes do not overlap.

2. The discharging and light emitting device according to claim 1, wherein said first substrate has said first fluorescent substance, said second substrate has said second fluorescent substance, and said first fluorescent substance has a larger thickness than the thickness of said second fluorescent substance.

3. The discharging and light emitting device according to claim 2, wherein said first fluorescent substance has a thickness in the range from 40 $\mu$m to 60 $\mu$m, and said second fluorescent substance has a thickness in the range from 3 $\mu$m to 10 $\mu$m.

4. The discharging and light emitting device according to claim 1, wherein said first electrode is provided on a surface on said discharging space side of said first substrate, said second electrode is provided on an outer surface on the opposite side to said discharging space side of said second substrate, and said second electrode is at a ground potential.

5. The discharging and light emitting device according to claim 4, further comprising an insulating layer covering said first electrode and having transmittancy, said insulating layer having a thickness in the range from 30 $\mu$m to 50 $\mu$m.

6. The discharging and light emitting device according to claim 1, wherein said second substrate has a wall extending toward said first substrate, and said second electrode is provided on the inner side than the wall of said second substrate.

7. The discharging and light emitting device according to claim 6, wherein the distance between the outer periphery of said second electrode and the outer periphery of said wall is at least 0.5 mm.

8. The discharging and light emitting device according to claim 1, wherein said first electrode is provided on an outer surface on the opposite side to said discharging space of said first substrate, said second electrode is provided on a surface on said discharging space side of said second substrate, and said first electrode is at a ground potential.

9. The discharging and light emitting device according to claim 8, further comprising an insulating layer covering said second electrode and having transmittancy, said insulating layer having a thickness in the range from 30 $\mu$m to 50 $\mu$m.

10. The discharging and light emitting device according to claim 9, wherein said insulating layer is provided with an opening reaching said second substrate, and said second fluorescent substance is formed on a surface of said second substrate positioned in said opening.

11. The discharging and light emitting device according to claim 1, wherein said first substrate has a wall extending toward said second substrate, and said first electrode is provided on the inner side than the wall of said first substrate.

12. The discharging and light emitting device according to claim 11, wherein the distance between the outer periphery of said first electrode and the outer periphery of said wall is at least 0.5 mm.

13. The discharging and light emitting device according to claim 1, wherein the amount by which said second electrode can be shifted from said first electrode is at least ½ the distance between said first and second substrates.

14. The discharging and light emitting device according to claim 1, wherein said first electrode has a flat plate shape, and said second electrode has an annular shape.

15. The discharging and light emitting device according to claim 1, wherein said discharging and light emitting device is used as a light source for a contact image sensor.

* * * * *